US006247804B1

(12) United States Patent
Watanabe

(10) Patent No.: US 6,247,804 B1
(45) Date of Patent: Jun. 19, 2001

(54) INK JET RECORDING APPARATUS WITH TANK FOR REACTION SOLUTION AND METHOD FOR PRODUCING THE TANK

(75) Inventor: Kazuaki Watanabe, Suwa (JP)

(73) Assignee: Seiko Epson Corporation, Tokyo-to (JP)

( * ) Notice: Subject to any disclaimer, the term of this patent is extended or adjusted under 35 U.S.C. 154(b) by 0 days.

(21) Appl. No.: 09/010,784

(22) Filed: Jan. 22, 1998

(30) Foreign Application Priority Data

Jan. 24, 1997 (JP) ..... 9-011735
Jan. 16, 1998 (JP) ..... 10-006449
Jan. 20, 1998 (JP) ..... 10-008710

(51) Int. Cl.[7] ..... B41J 2/175; B41J 2/01
(52) U.S. Cl. ..... 347/86; 347/101
(58) Field of Search ..... 347/86, 87, 101

(56) References Cited

U.S. PATENT DOCUMENTS 4,689,642 * 8/1987 Sugitani ..... 347/87
4,914,453 4/1990 Kanayama et al. ..... 346/140 R
5,156,472 * 10/1992 Suzuki et al. ..... 347/86 X
5,552,816 * 9/1996 Oda et al. ..... 347/86
5,790,158 * 8/1998 Shinada et al. ..... 347/86
5,801,737 * 9/1998 Sato et al. ..... 347/86

FOREIGN PATENT DOCUMENTS 0534634 3/1993 (EP) .
0738605 10/1996 (EP) .

* cited by examiner

*Primary Examiner*—Fred L Braun
(74) *Attorney, Agent, or Firm*—Ladas & Parry

(57) ABSTRACT

A tank, containing a reaction solution, for use in an ink jet recording apparatus for depositing two liquids, that is, a reaction solution, containing a polyvalent metal salt, and an ink composition, onto a recording medium to conduct printing. This tank can solve a clogging problem of the reaction solution. A reaction solution containing a polyvalent metal salt is sealed into a reaction solution tank under reduced pressure. This prevents the reaction solution from creating a precipitate and, even after storage of the reaction solution for a long period of time, can realize good printing, especially clogging-free, stable printing A process for producing the reaction solution tank involves the steps of (a) evacuating a reaction solution reservoir through a communicating hole; (b) feeding and filling the reaction solution through the communicating hole into the reaction solution tank; and (c) evacuating the reaction solution reservoir and hermetically sealing the reaction solution reservoir in an evacuated state with a gas-impermeable sealing member.

19 Claims, 3 Drawing Sheets

INK JET RECORDING APPARATUS WITH TANK FOR REACTION SOLUTION AND METHOD FOR PRODUCING THE TANK

BACKGROUND OF THE INVENTION

1 Field of the Invention

The present invention relates to an ink jet recording apparatus wherein a reaction solution and an ink composition are deposited onto a recording medium to conduct printing and also relates to a tank containing the reaction solution for use in the ink jet recording apparatus.

2 Background Art

An ink jet recording method is a printing method wherein droplets of an ink composition are ejected and deposited onto a recording medium such as paper. This method has a feature that an image having a high resolution and a high quality can be printed at a high speed with a relatively inexpensive apparatus. In general, the ink composition used in the ink jet recording comprises water as a main component and, added thereto, a colorant and a wetting agent, such as glycerin, for prevention of clogging and other purposes.

A new ink jet recording method has been recently proposed which comprises applying a polyvalent metal salt solution onto a recording medium and then applying an ink composition containing a dye having at least one carboxyl group (for example, Japanese Patent Laid-Open No. 202328/1993).

Further, several other ink jet recording methods have also been proposed wherein two liquids, i.e., a polyvalent metal salt solution and an ink composition, are printed (for example, Japanese Patent Laid-Open Nos. 63185/1989, 240557/1991, 240558/1991, 52868/1996, and 207424/1997).

The claimed advantage of the ink jet recording methods using the two liquids is that, upon printing of the polyvalent metal solution (hereinafter often referred to as "reaction solution") and the ink composition onto a recording medium, the polyvalent metal salt combines mainly with a colorant to form an insoluble complex which can yield an image having water resistance and a high quality free from color bleeding.

The salt of a polyvalent metal, however, has low solubility in water. Therefore, use of a polyvalent metal salt solution after storage for a long period of time results in such an unfavorable phenomenon that a precipitate clogs a filter, inhibiting the reaction solution from being fed into a recording head, or otherwise the precipitate enters the recording head to unfavorably clog a fine nozzle.

SUMMARY OF THE INVENTION

The present inventor has now found that, in the ink jet recording apparatus wherein two liquids are printed to form an image, sealing of a solution containing a polyvalent metal salt into a reaction solution tank under reduced pressure can realize good printing, especially clogging-free, stable printing even after storage for a long period of time. The present invention has been made based on such finding.

Accordingly, an object of the present invention is to provide an ink jet recording apparatus, capable of realizing good printing, wherein two liquids are printed, and a reaction solution tank used therefor.

According to one aspect of the present invention, there is provided an ink jet recording apparatus for depositing a reaction solution, containing a polyvalent metal salt, and an ink composition onto a recording medium to conduct printing, said ink jet recording apparatus comprising: a reaction solution tank containing the reaction solution; and an ink composition tank containing the ink composition, the reaction solution tank containing the reaction solution sealed therein under reduced pressure.

According to another aspect of the present invention, there is provided a reaction solution tank, containing a reaction solution, for use in an ink jet recording apparatus for depositing a reaction solution, containing a polyvalent metal salt, and an ink composition onto a recording medium to conduct printing, the reaction solution tank containing the reaction solution sealed therein under reduced pressure.

DETAILED DESCRIPTION OF THE INVENTION

Ink Jet Recording Apparatus and Reaction Solution Tank

The ink jet recording apparatus and the reaction solution tank according to the present invention will be described with reference to the accompanying drawings.

Figure 1:
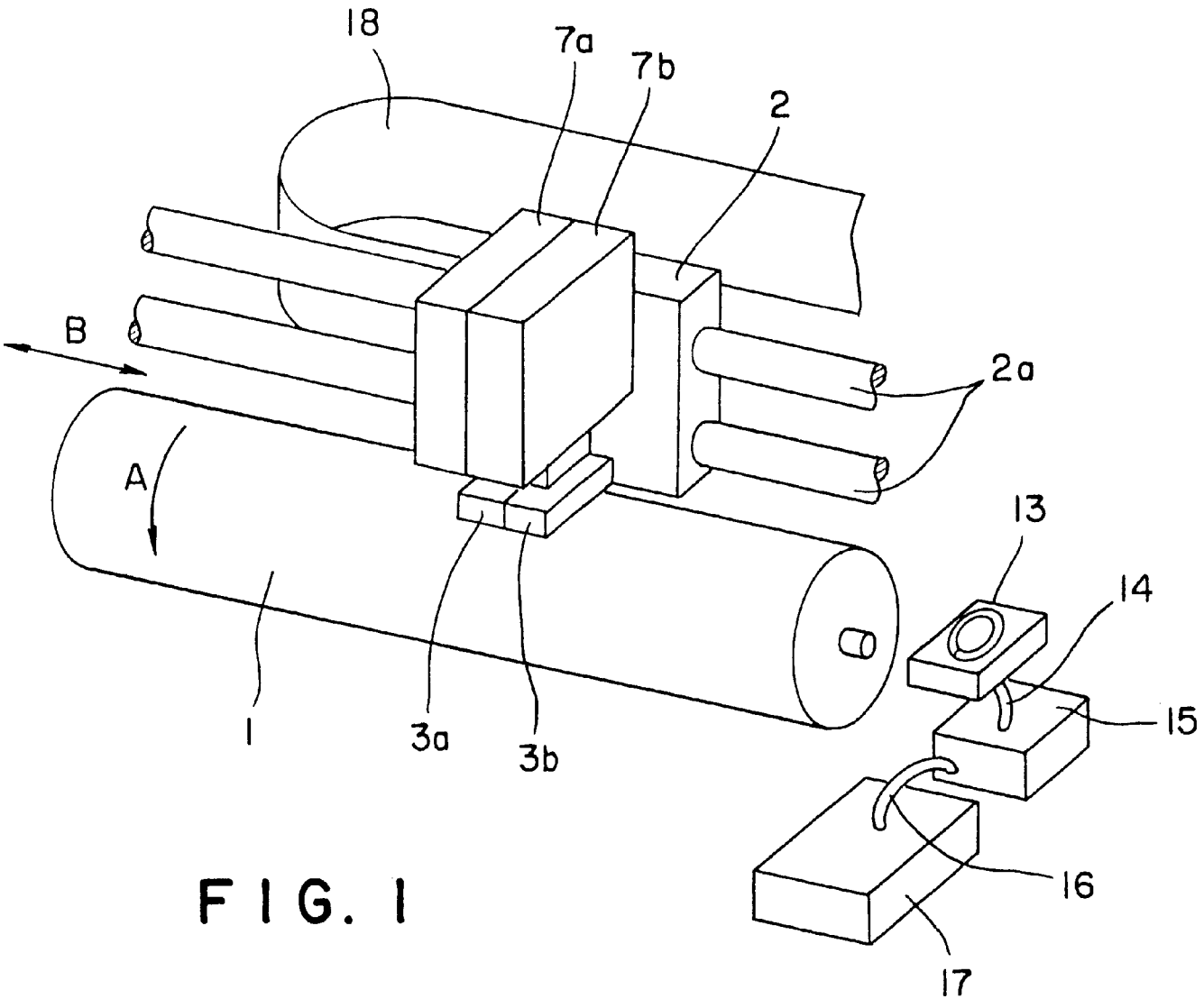
FIG. 1 is a perspective view of an ink jet recording apparatus according to the present invention.

FIG. 1 is a diagram showing one embodiment of the ink jet recording apparatus according to the present invention. The apparatus shown in the drawing comprises a carriage 2 which is reciprocated in a direction indicated by an arrow B on a guide shaft 2*a* along a platen 1 as recording paper carrying means rotated in a direction indicated by an arrow A for carrying recording paper. The carriage 2 is loaded with a recording head 3*a* for ejecting a reaction solution in a position close to the platen 1 and a recording head 3*b* for ejecting an ink composition. A tank 7*a* for a reaction solution is provided above the recording head 3*a*, while a tank 7*b* for an ink composition is provided above the recording head 3*b*. A reaction solution from the reaction solution tank 7*a* and an ink composition from the ink composition tank 7*b* are fed respectively into the recording head 3*a* and the recording head 3*b*.

A signal is sent to the recording heads 3*a* and 3*b* through a signal cable 18, and, in response to the signal, droplets of the reaction solution or droplets of the ink composition are ejected from the recording head 3*a* or 3*b* through a nozzle (not shown). The ejected droplets of the reaction solution or the ink composition are deposited onto a recording medium 20 (for example, paper) wound around the platen 1 to yield an image.

When clogging has occurred in the recording head, the nozzle face of the recording head is sealed with a cap member 13, followed by suction of the reaction solution or the ink composition by means of a pump 15 connected through the cap member 13 and a conduit 14 to eliminate the clogging. The sucked reaction solution or ink composition is led to a waste tank 17 through a conduit 16.

In the drawing, only one cap member is provided. Alternatively, a plurality of cap members may be provided respectively for the recording heads 3*a* and 3*b*.

Figure 2:
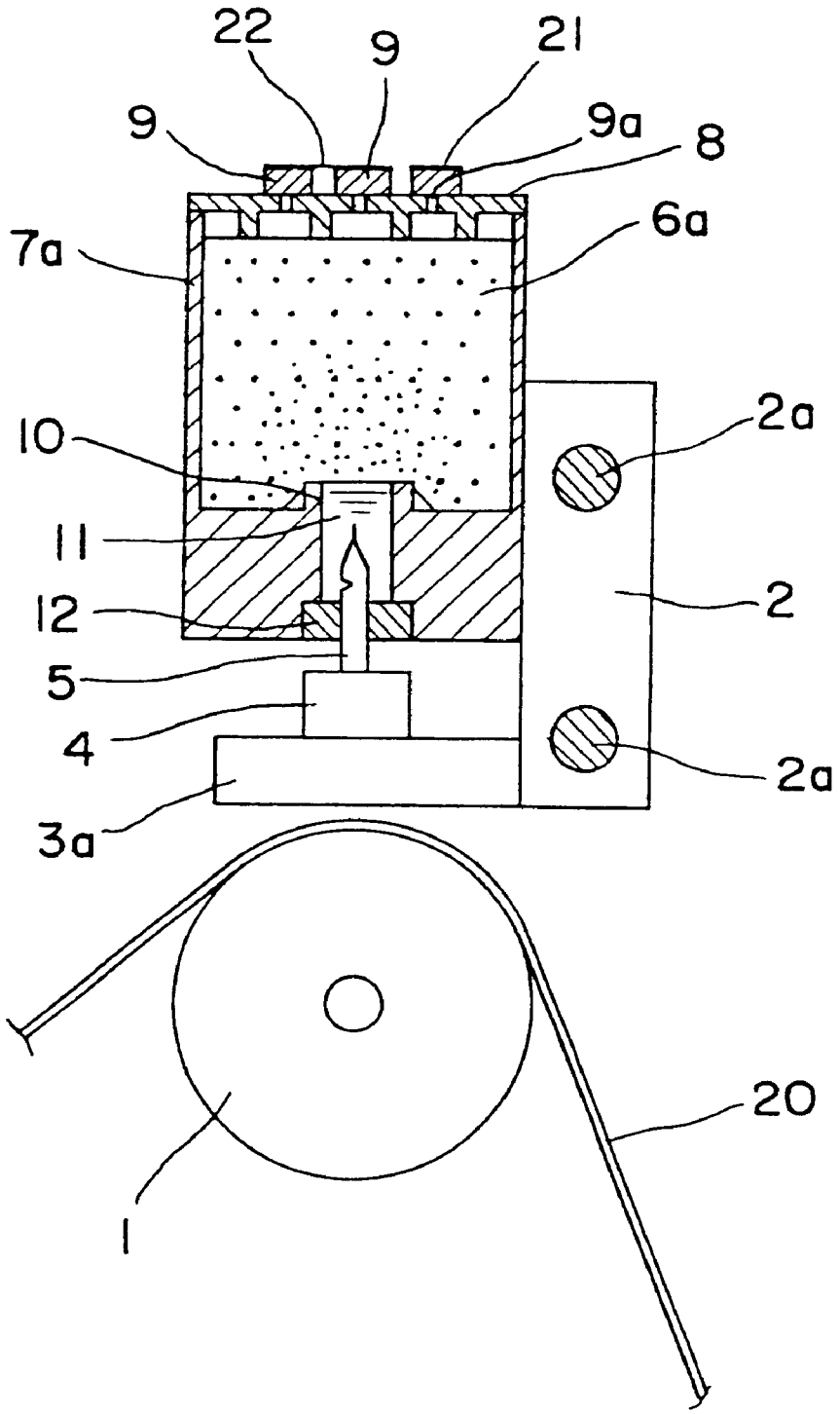
FIG. 2 is an explanatory cross-sectional view of an embodiment of the ink jet recording apparatus according to the present invention.
Figure 3:
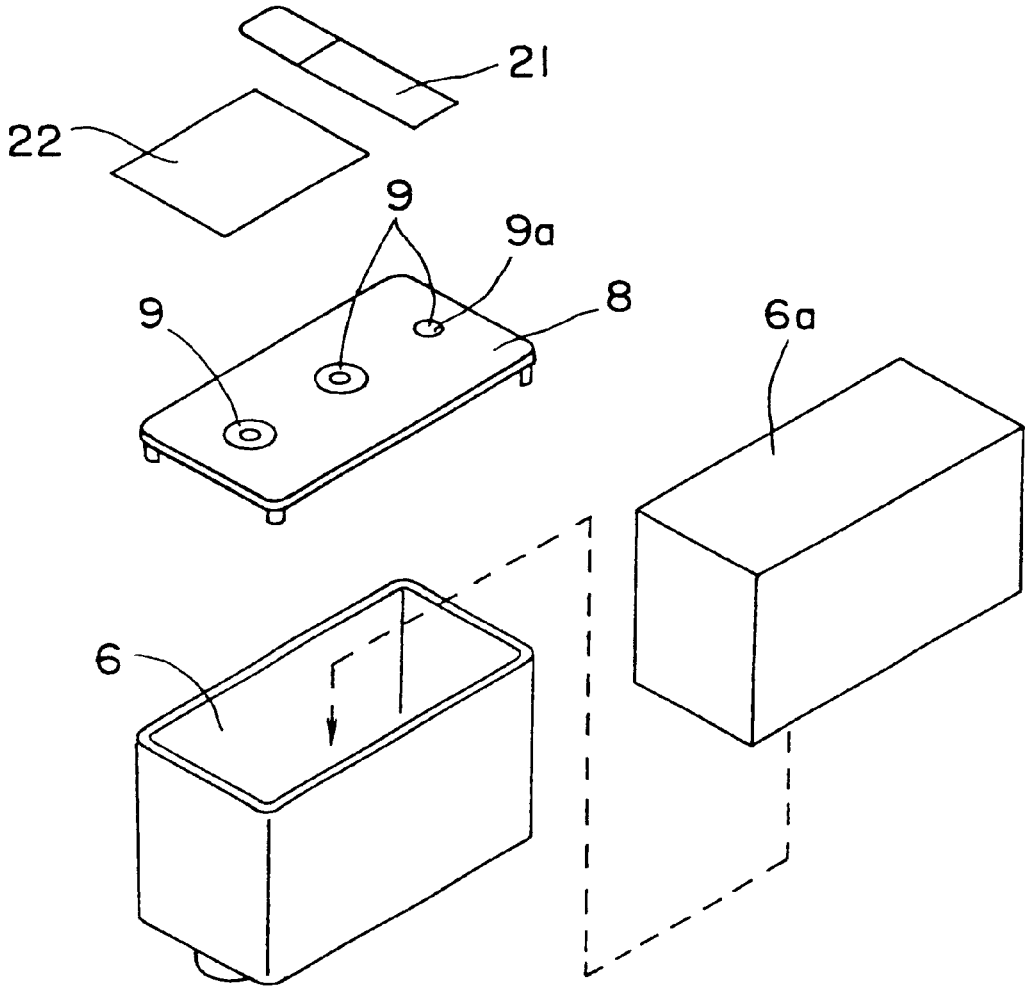
FIG. 3 is an exploded, perspective view of a reaction solution tank for the ink jet recording apparatus according to the present invention.

The reaction solution tank according to the present invention will be described. FIG. 2 is a cross-sectional view of the ink jet recording apparatus shown in FIG. 1, and FIG. 3 is an exploded, perspective view of a reaction solution tank 7*a*. A reaction solution tank 7*a* having a reaction solution reservoir 6 housing therein a foam 6*a* constituted by a porous member, such as a polyurethane foam, is provided above the recording head 3*a*. The reaction solution tank 7*a* has a lid 8 provided with a communicating hole 9 communicated with the outside of the reaction solution tank. On the other hand, a base-like protrusion 10 is provided on the bottom face so as to intimately contact with the foam 6*a*. There is a communicating section, communicated with the recording head 3*a*, extending downward from the center portion of the protrusion 10. The communicating section comprises a reaction solution chamber 11 for withdrawing and holding the reaction solution contained in the foam 6*a* and a cap 12, constituted by an elastic member, such as rubber, provided at the end of the reaction solution chamber 11.

Insertion of a hollow needle 5 as a communicating member communicated with the recording head 3*a* and a filter chamber 4 provided on the carriage into the cap 12 permits the reaction solution impregnated within the reaction solution tank 7*a* to be fed into the recording head 3*a*.

At least one communicating hole 9 is placed in a sealed state using an openable, gas-impermeable sealing member 21 under reduced pressure until immediately before use. Immediately before use, the gas-impermeable sealing member 21 is opened to communicate the reaction solution tank 7*a* with the outside of the reaction solution tank 7*a* through an air hole 9*a*. Preferably, the sealing member 21 is constructed so that, as shown in FIG. 3, it has a satisfactory long section and can be easily opened by picking up the end of the long section. During printing, the air hole 9*a* functions to replenish the reaction solution tank 7*a* with air by a volume equal to the volume of the consumed reaction solution.

In the reaction solution tank according to the present invention, the reaction solution is contained in the reaction solution tank under reduced pressure. The air hole 9*a* has been sealed. The reaction solution under reduced pressure does not create a precipitate. Consequently, the reaction solution, when used in printing after mounting on an ink jet recording apparatus, neither causes clogging of the filter with the precipitate nor causes the precipitate to flow into the recording head to unfavorably clog a fine nozzle. Thus, use of a reaction solution filled into the reaction solution tank according to the present invention enables clogging-free, stable printing.

According to a preferred embodiment of the present invention, the pressure in the reaction solution tank is less than atmospheric pressure, preferably not more than 0.05 MPa, and more preferably not more than 0.02 MPa.

The reaction solution tank according to the present invention is preferably produced by the following process. First, the reaction solution tank 7 is assembled, while the sealing members 21 and 22 are not assembled. The reaction solution reservoir 6 in the reaction solution tank 7 is evacuated through the communicating hole 9. The degree of evacuation may be properly determined. When the amount of the reaction solution filled and the filling time are taken into consideration, however, the reaction solution tank is evacuated to a pressure of preferably not more than 0.05 MPa, more preferably not more than 0.02 MPa. Subsequently, the reaction solution is filled into the reaction solution tank through the communicating hole 9. At that time, the pressure of the reaction solution is reduced to provide a deaerated reaction solution. The communicating hole 9 except for the air hole 9*a* is sealed with the sealing member 22 under atmospheric pressure. Thereafter, in the step of vacuum hermetic sealing, the reaction solution tank 7 is evacuated, and the air hole 9*a* is sealed with the sealing member 21. According to a preferred embodiment of the present invention, the internal pressure of the reaction solution reservoir 6 is reduced to not more than 0.05 MPa, more preferably not more than 0.02 MPa.

Reaction Solution

According to the present invention, the reaction solution comprises at least a polyvalent metal salt.

The polyvalent metal salt usable in the reaction solution is constituted by divalent or higher polyvalent metallic ions and anions bonded to the polyvalent metallic ions and is soluble in water. Specific examples of polyvalent metallic ions include divalent metallic ions, such as $Ca^{2+}$, $Cu^{2+}$, $Ni^{2+}$, $Mg^{2+}$, $Zn^{2+}$, and $Ba^{2+}$, trivalent metallic ions, such as $Al^{3+}$, $Fe^{3+}$, and $Cr^{3+}$. Anions include $Cl^-$, $NO_3^-$, $I^-$, $Br^-$, $ClO_3^-$, and $CH_3COO^-$.

Especially, a metal salt constituted by $Ca^{2+}$or $Mg^{2+}$ provides favorable results in terms of pH of the reaction solution and the quality of prints.

The concentration of the polyvalent metal salt in the reaction solution may be suitably determined so as to attain the effect of providing a good print quality and preventing clogging. It, however, is preferably about 0.1 to 40% by weight, more preferably about 5 to 25% by weight.

According to a preferred embodiment of the present invention, the reaction solution contains a wetting agent comprising a high-boiling organic solvent. The high-boiling organic solvent serves to prevent the reaction solution from being concentrated due to evaporation, thus preventing clogging of a recording head. Preferred examples of high-boiling organic solvents usable herein include: polyhydric alcohols such as ethylene glycol, diethylene glycol, triethylene glycol, polyethylene glycol, propylene glycol, polypropylene glycol, butylene glycol, hexylene glycol, 1,2,6-hexanetriol, thioglycol, glycerin, trimethylolethane, and trimethylolpropane; alkyl ethers of polyhydric alcohols, such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, and triethylene glycol monoethyl ether, and triethylene glycol monobutyl ether; 2-pyrrolidone; N-methyl-2-pyrrolidone; 1,3-dimethyl-2-imidazolidinone; and triethanolamine.

Although the amount of the high-boiling organic solvent added is not particularly limited, it is preferably about 0.5 to 40% by weight, more preferably about 2 to 20% by weight.

According to a preferred embodiment of the present invention, the reaction solution comprises a low-boiling organic solvent. Preferred examples of low-boiling organic solvents usable herein include methanol, ethanol, n-propyl alcohol, iso-propyl alcohol, n-butanol, sec-butanol, tert-butanol, iso-butanol, and n-pentanol. Monohydric alcohols are particularly preferred. The low-boiling organic solvent has the effect of shortening the time taken for drying the ink. The amount of the low-boiling organic solvent added is preferably in the range of from 0.5 to 10% by weight, more preferably in the range of from 1.5 to 6% by weight.

According to a preferred embodiment of the present invention, the reaction solution comprises a penetrating agent. Penetrating agents usable herein include various surfactants such as anionic, cationic, and amphoteric surfactants; alcohols such as methanol, ethanol, and iso-propyl alcohol; and lower alkyl ethers of polyhydric alcohols, such as ethylene glycol monomethyl ether, diethylene glycol monoethyl ether, diethylene glycol monobutyl ether, triethylene glycol monobutyl ether, propylene glycol monobutyl ether, and dipropylene glycol monobutyl ether.

Ink Composition

The ink composition used in the present invention comprises at least a colorant, an organic solvent, water, and preferably a resin emulsion. The colorant may be any of a dye and a pigment. Dyes usable herein include various dyes commonly used in ink jet recording, such as direct dyes, acid dyes, foodstuff dyes, basic dyes, reactive dyes, disperse dyes, and vat dyes. Regarding the pigment, inorganic and organic pigments are usable without any particular limitation. The pigment is generally added, to the ink, as a pigment dispersion prepared by dispersing the pigment in an aqueous medium with the aid of a dispersant. Many of the dyes and pigments react with polyvalent metallic ions contained in the reaction solution to produce a metal complex insoluble or sparingly soluble in water, yielding a print having sharp edge and free from color bleeding.

A resin emulsion also reacts with polyvalent metallic ions to produce an insoluble complex. Therefore, the addition of the resin emulsion can greatly contribute to an improvement in print quality.

The ink composition may further comprise an organic solvent. Further, addition of other components is not particularly limited. Especially, incorporation of a component, which can react with polyvalent metallic ions to produce a complex insoluble or sparingly soluble in water, into the ink composition is preferred. In general, the ink composition comprises water as a main component and, added thereto, a colorant and a wetting agent, such as glycerin, for prevention of clogging and other purposes.

EXAMPLES

The present invention will be described in more detail with reference to the following examples, though it is not limited to these examples only.

| | |
|---|---|
| Reaction solution 1 | |
| Magnesium nitrate hexahydrate | 25 wt % |
| Triethylene glycol monobutyl ether | 10 wt % |
| Glycerin | 20 wt % |
| Pure water | Balance |
| Reaction solution 2 | |
| Magnesium nitrate hexahydrate | 5 wt % |
| Triethylene glycol monobutyl ether | 10 wt % |
| Glycerin | 20 wt % |
| Triethanolamine | 0.9 wt % |
| Pure water | Balance |
| Reaction solution 3 | |
| Calcium nitrate tetrahydrate | 10 wt % |
| Triethylene glycol monobutyl ether | 10 wt % |
| Glycerin | 20 wt % |
| Triethanolamine | 0.9 wt % |
| Pure water | Balance |

Filling of Reaction Solution into Tank

Each of the above reaction solutions was filled into a reaction solution tank. In particular, a tank having a basic structure shown in FIG. 2 was assembled, and the reaction solution reservoir 6 of the assembled reaction solution tank 7 was evacuated to a pressure of not more than 0.05 MPa through the communicating hole 9. Subsequently, the reaction solution was then filled into the reaction solution tank through the communicating hole 9. The communicating hole 9 except for the air hole 9*a* was then sealed with a sealing member 22. Thereafter, in the step of hermetic sealing, the reaction solution tank 7 was evacuated, and the communicating hole 9*a* was sealed with a sealing member 21. The reaction solution tank was evacuated to two levels of pressure as specified in Table 1, that is, 0.05 MPa and 0.02 MPa. Further, for comparison, the evacuation was not performed after filling of the reaction solution, and the sealing was conducted under atmospheric pressure. These three tanks respectively having three levels of pressure in sealed state were provided for each of the reaction solutions 1 to 3. The reaction solution tanks were then subjected to an accelerated test corresponding to a storage under ordinary temperature and ordinary humidity conditions for one year.

Printing Test

The solution tank which was subjected to the accelerated test above was loaded onto an ink jet printer MJ-510C (manufactured by Seiko Epson Corporation). A pattern containing a combination of characters with graphics was continuously printed on paper of size A4. At that time, ejection of droplets of the reaction solution from the nozzle was visually inspected, and the results were evaluated according to the following criteria.

A: Number of sheets printable without "dropout" and "ejection of droplets with trajectories non-perpendicular to the print head", 500 or more B: Number of sheets printable without "dropout" and "ejection of droplets with trajectories non-perpendicular to the print head", 300 to less than 500

C: Number of sheets printable without "dropout" and "ejection of droplets with trajectories non-perpendicular to the print head", 100 to less than 300

NG: Number of sheets printable without "dropout" and "ejection of droplets with trajectories non-perpendicular to the print head", less than 100.

The results of evaluation were as summarized in the following table.

TABLE 1

| | Example 1 | Example 2 | Comparative Example |
|---|---|---|---|
| Pressure of reaction solution tank (MPa) | 0.05 | 0.02 | Atmospheric pressure |
| Reaction solution 1 | B | A | C |
| Reaction solution 2 | A | A | C |
| Reaction solution 3 | A | A | NG |

What is claimed is:

1. An ink jet recording apparatus for depositing a reaction solution, containing a polyvalent metal salt, and an ink composition onto a recording medium, said ink jet recording apparatus comprising: a reaction solution tank containing the reaction solution; and an ink composition tank containing the ink composition, the reaction solution tank containing the reaction solution sealed therein under reduced pressure.

2. The ink jet recording apparatus according to claim 1, wherein the reduced pressure is a pressure of less than atmospheric pressure.

3. The ink jet recording apparatus according to claim 1, wherein the reduced pressure is a pressure of not more than 0.05 MPa.

4. An ink jet recording apparatus according to claim 1 wherein the reaction solution comprises said polyvalent metal salt in an amount of about 5 to 25% by weight and water as a main solvent.

5. A reaction solution tank, containing a reaction solution, for use in an ink jet recording apparatus for depositing a reaction solution, containing a polyvalent metal salt, and an ink composition onto a recording medium to conduct printing, the reaction solution tank containing the reaction solution sealed therein under reduced pressure.

6. The reaction solution according to claim 5, wherein the reduced pressure is a pressure of less than atmospheric pressure.

7. The reaction solution tank according to claim 5, wherein the reduced pressure is a pressure of not more than 0.05 MPa.

8. A reaction solution tank according to claim 5, wherein the reaction solution comprises said polyvalent metal salt in an amount of about 5 to 25% by weight and water as a main solvent.

9. A reaction solution tank, containing a reaction solution, for use in an ink jet recording apparatus for depositing a reaction solution, containing a polyvalent metal salt, and an ink composition onto a recording medium to conduct printing, the reaction solution tank comprising: a reaction solution reservoir; a communicating section communicated with the reaction solution reservoir and a recording head; at least one communicating hole communicated with the outside of the reaction tank; and a gas-impermeable sealing member for hermetically sealing the communicating hole, the reaction solution being sealed into the reaction solution reservoir under reduced pressure.

10. The reaction solution tank according to claim 9, wherein the reduced pressure is a pressure of less than atmospheric pressure.

11. The reaction solution tank according to claim 9, wherein the reduced pressure is a pressure of not more than 0.05 MPa.

12. A reaction solution tank according to claim 9, wherein the reaction solution comprises said polyvalent metal salt in an amount of about 5 to 25% by weight and water as a main solvent.

13. A process for producing a reaction solution tank, containing a reaction solution, for use in an ink jet recording apparatus for depositing a reaction solution, containing a polyvalent metal salt, and an ink composition onto a recording medium to conduct printing, said reaction solution tank comprising: a reaction solution reservoir; a communicating section communicated with the reaction solution reservoir and a recording head; at least one communicating hole communicated with the outside of the reaction tank; and a gas-impermeable sealing member for hermetically sealing the communicating hole, said process comprising the steps of:

(a) evacuating the reaction solution reservoir through the communicating hole;

(b) feeding and filling the reaction solution through the communicating hole into the reaction solution tank; and (c) evacuating the reaction solution reservoir and hermetically sealing the reaction solution reservoir in an evacuated state with the gas-impermeable sealing member.

14. The process according to claim 13, wherein, in the step (c), the reaction solution reservoir is evacuated to a pressure of less than atmospheric pressure.

15. The process according to claim 13, wherein, in the step (c), the reaction solution reservoir is evacuated to a pressure of not more than 0.05 MPa.

16. A process according to claim 13, wherein the reaction solution comprises said polyvalent metal salt in an amount of about 5 to 25% by weight and water as a main solvent.

17. In a process for ink jet printing comprising (a) providing an ink jet apparatus comprising (i) a reaction solution tank containing a reaction solution including a polyvalent metal salt; (ii) an ink composition tank containing an ink composition that is combinable with the polyvalent metal salt to form an insoluble complex; (iii) first recording head means for ejecting said ink composition; and (iv) second recording head means for ejecting the reaction solution; (b) continuously ejecting said reaction solution and said polyvalent metal salt from the respective reaction solution and ink composition tanks through the respective first and second recording head means; and (c) depositing the reaction solution and ink composition onto a recording medium to form the complex thereon, the improvement comprising maintaining the reaction solution in the reaction solution tank under a reduced pressure that inhibits a precipitate of the reaction solution from clogging a nozzle or filter of the second recording head means during said ejecting.

18. A process according to claim 17, wherein the reduced pressure is a pressure of not more than 0.05 MPa.

19. A process according to claim 17, wherein the reaction solution comprises said polyvalent metal salt in an amount of about 5 to 25% by weight and water as a main solvent.

* * * * *